US010829903B2

(12) United States Patent
Shimomura et al.

(10) Patent No.: US 10,829,903 B2
(45) Date of Patent: Nov. 10, 2020

(54) DEVICE FOR CALCULATING CONSTRUCTION ASSISTANCE INFORMATION, SYSTEM FOR CALCULATING CONSTRUCTION ASSISTANCE INFORMATION, AND PROGRAM

(71) Applicants: NIHON UNIVERSITY, Tokyo (JP); Marufuji Sheet Piling Co., Ltd., Tokyo (JP)

(72) Inventors: Shuichi Shimomura, Tokyo (JP); Masaki Nakai, Tokyo (JP); Yasuo Sato, Chiba (JP)

(73) Assignees: NIHON UNIVERSITY, Tokyo (JP); Marufuji Sheet Piling Co., Ltd., Tokyo (JP)

( * ) Notice: Subject to any disclaimer, the term of this patent is extended or adjusted under 35 U.S.C. 154(b) by 478 days.

(21) Appl. No.: 15/560,313

(22) PCT Filed: Mar. 10, 2016

(86) PCT No.: PCT/JP2016/057663
§ 371 (c)(1),
(2) Date: Sep. 21, 2017

(87) PCT Pub. No.: WO2016/152568
PCT Pub. Date: Sep. 29, 2016

(65) Prior Publication Data

US 2018/0058030 A1 Mar. 1, 2018

(30) Foreign Application Priority Data

Mar. 23, 2015 (JP) ..... 2015-059550

(51) Int. Cl.
*E02D 13/06* (2006.01)
*E02D 7/18* (2006.01)

(52) U.S. Cl.
CPC ..... *E02D 13/06* (2013.01); *E02D 7/18* (2013.01)

(58) Field of Classification Search
CPC ..... E02D 13/02; E02D 13/06; E02D 7/18; H02K 7/06; H02K 7/075
See application file for complete search history.

(56) References Cited

U.S. PATENT DOCUMENTS 5,978,749 A * 11/1999 Likins, Jr. ..... E02D 13/00 700/108
6,082,173 A * 7/2000 Wai ..... E02D 33/00 73/12.01

(Continued)

FOREIGN PATENT DOCUMENTS

JP 50-061011 5/1975
JP 03-093915 4/1991

(Continued)

OTHER PUBLICATIONS

European Search Report, dated Oct. 18, 2018, in connection with European Application No. 16768471.1.

(Continued)

*Primary Examiner* — Catherine T. Rastovski
(74) *Attorney, Agent, or Firm* — Meunier Carlin & Curfman LLC

(57) ABSTRACT

A device for calculating construction assistance information includes: an acquisition unit that acquires, from a vibratory hammer construction machine, information that contains at least values indicating a eccentricity force of a vibratory hammer which the vibratory hammer construction machine imparts to a construction object, the number of impacts, and a depth of penetration of the construction object; and a calculation unit that calculates a accumulated impact force (Continued)

indicating a work load of construction on the basis of the information acquired by the acquisition unit.

1 Claim, 7 Drawing Sheets

(56) References Cited

U.S. PATENT DOCUMENTS

| | | | | |
|---|---|---|---|---|
| 2007/0074881 | A1 | 4/2007 | Bermingham et al. | |
| 2011/0056750 | A1* | 3/2011 | Lucon | E21B 44/00 175/56 |
| 2016/0122968 | A1* | 5/2016 | Jung | E02D 7/14 405/232 |

FOREIGN PATENT DOCUMENTS

| | | |
|---|---|---|
| JP | 2001-131972 | 5/2001 |
| JP | 2004-332462 | 11/2004 |
| JP | 2009-133163 | 6/2009 |
| JP | 2010-059670 | 3/2010 |

OTHER PUBLICATIONS

International Search Report dated Jun. 7, 2016 from International Application No. PCT/JP2016/057663, 4 pages.
English Translation of Office Action dated Sep. 15, 2015, from Japanese Patent Application No. 2015-059550, 5 pages.

* cited by examiner

DEVICE FOR CALCULATING CONSTRUCTION ASSISTANCE INFORMATION, SYSTEM FOR CALCULATING CONSTRUCTION ASSISTANCE INFORMATION, AND PROGRAM

CROSS-REFERENCE TO RELATED APPLICATIONS

This application is a national stage application filed under 35 U.S.C. § 371 of PCT/JP2016/057633 filed Mar. 10, 2016, which claims benefit of Japanese Application No. 2015-059550 filed Mar. 23, 2015, which are hereby incorporated by reference in their entireties.

TECHNICAL FIELD

The present invention relates to a device for calculating construction assistance information, a system for calculating construction assistance information, a vibratory hammer construction machine, and a program.

Priority is claimed on Japanese Patent Application No. 2015-59550, filed on Mar. 23, 2015, the content of which is incorporated herein by reference.

BACKGROUND ART

Conventionally, there is a standard penetration test for evaluating whether or not a pile used for, for instance, a foundation of a building reaches a bearing stratum under the ground. In this standard penetration test, a depth at which the bearing stratum is present is indicated by an N-value. The N-value is a value indicated by the number of impacts required to penetrate a sampler that is a reference pile into the ground by a predetermined depth using a given hammering apparatus. In a conventional construction method, for instance a conventional vibratory hammer construction method, it is determined that a pile is penetrated to a depth at which a bearing stratum is present and which is indicated by this N-value, and thereby the penetrated pile reaches the bearing stratum (e.g., see Patent Literature 1).

CITATION LIST

Patent Literature

[Patent Literature 1]

Japanese Unexamined Patent Application, First Publication No. 2001-131972

SUMMARY OF INVENTION

Technical Problem

Here, in some cases, the depth of the bearing stratum is different at each buried position of the pile. Therefore, the depth of the bearing stratum is preferably found at each buried position of the pile. However, it is troublesome to make a standard penetration test for each buried pile. Meanwhile, there is no means for calculating a highly accurate index substituted for the N-value for each buried pile. Accordingly, in the conventional vibratory hammer construction method, it was impossible to calculate the index indicating the depth of the bearing stratum for each construction object with high accuracy.

Thus, an object of the present invention is to provide a device for calculating construction assistance information, a system for calculating construction assistance information, a vibratory hammer construction machine, and a program, which can calculate an index indicating a depth of a bearing stratum for each construction object with high accuracy in a vibratory hammer construction method.

Solution to Problem

An embodiment of the present invention is a device for calculating construction assistance information, which includes: an acquisition unit configured to acquire information, which contains at least values indicating a eccentricity force of a vibratory hammer which a vibratory hammer construction machine imparts to a construction object, the number of impacts, and a depth of penetration of the construction object, from the vibratory hammer construction machine; and a calculation unit configured to calculate an accumulated impact force indicating a work load of construction caused by the vibratory hammer on the basis of a ratio between a product of the eccentricity force and the number of impacts and the depth of penetration of the construction object, which are contained in the information acquired by the acquisition unit.

According to an embodiment of the present invention, in the device for calculating construction assistance information, the acquisition unit acquires the information with respect to each unit amount; and the calculation unit calculates the accumulated impact force on the basis of the information acquired by the acquisition unit with respect to each unit amount.

According to an embodiment of the present invention, the device for calculating construction assistance information further includes an output unit configured to store the accumulated impact force calculated by the calculation unit in a storage device.

An embodiment of the present invention is a system for calculating construction assistance information which includes: the device for calculating construction assistance information described above; and a display unit configured to display a result of calculation of the calculation unit which the device for calculating construction assistance information has.

An embodiment of the present invention is a vibratory hammer construction machine, which includes: the device for calculating construction assistance information described above; or the system for calculating construction assistance information described above.

An embodiment of the present invention is a program for executing, on a computer, a step of acquiring information, which contains at least values indicating a eccentricity force of a vibratory hammer which a vibratory hammer construction machine imparts to a construction object, the number of impacts, and a depth of penetration of the construction object, from the vibratory hammer construction machine, and a step of calculating an accumulated impact force indicating a work load of construction caused by the vibratory hammer on the basis of a ratio between a product of the eccentricity force and the number of impacts and the depth of penetration of the construction object, which are contained in the information acquired by the acquisition unit.

Advantageous Effects of Invention

The present invention can provide a device for calculating construction assistance information, a system for calculating construction assistance information, a vibratory hammer construction machine, and a program, which can calculate an index indicating a depth of a bearing stratum for each construction object with high accuracy in a vibratory hammer construction method.

DESCRIPTION OF EMBODIMENTS

Figure 1:
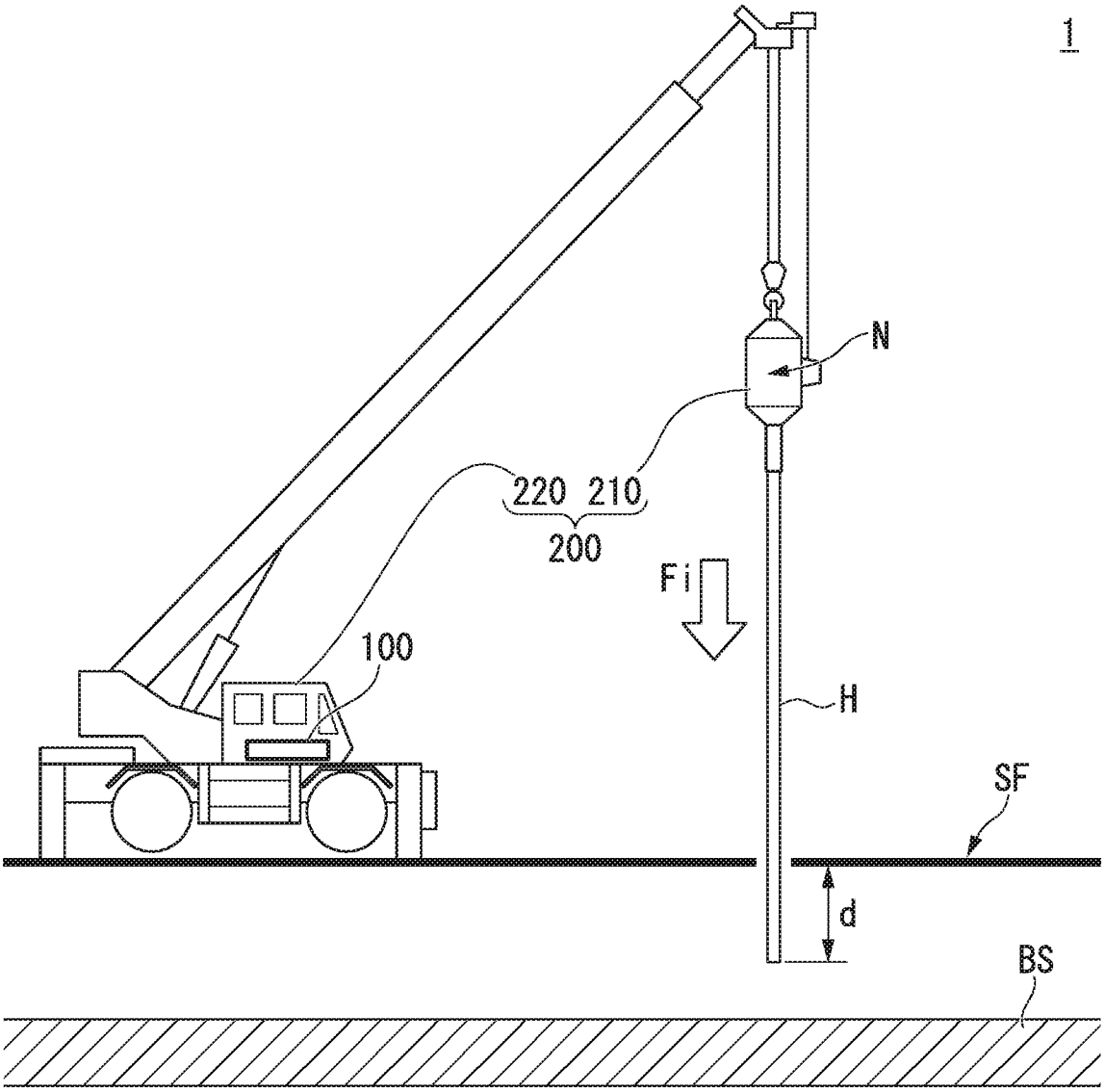
FIG. 1 is a schematic diagram illustrating key parts of a constitution of a system for calculating construction assistance information according to an embodiment of the present invention.

[With Respect to Vibratory Hammer Construction Method]

First, an outline of a vibratory hammer construction method will be described. The vibratory hammer construction method is a construction method of imparting underground vibrations via a construction object when the construction object is penetrated into the ground, reducing frictional resistance between the construction object and the ground, and thereby facilitating the penetration of the construction object into the ground. In the vibratory hammer construction method, the construction is performed using a vibratory hammer construction machine. The vibratory hammer construction machine includes a crane and a vibratory hammer that is suspended by the crane. The vibratory hammer includes a grasper for grasping the construction object. The vibratory hammer construction machine winds down the crane while grasping the construction object with the grasper of the vibratory hammer, and thereby moving the vibratory hammer in a vertical direction. Thereby, the vibratory hammer construction machine penetrates the construction object into the ground in the vertical direction.

A vibration exciter is provided inside the vibratory hammer. The vibratory hammer penetrates the construction object into the ground while transmitting a force generated by the vibration exciter to the construction object as a vibration.

The vibratory hammer construction machine can adjust a magnitude of the force which the vibration exciter applies to the construction object, and a frequency at which the force is applied. In the following description, the construction for penetrating the construction object into the ground is also referred to as a burial.

In the vibratory hammer construction method, the construction object is penetrated to a stratum called a bearing stratum. The bearing stratum is a stratum that supports a vertical load imparted to the construction object.

In this example, the case in which the construction object is a foundation pile for supporting a building under the ground will be described. In this case, the bearing stratum supports a load of the building which is applied to the foundation pile (hereinafter referred to simply as a "pile").

Here, determining a depth of the bearing stratum in the case of the related art will be described.

As described above, in the vibratory hammer construction method, the construction object is penetrated into the ground until an underground side leading end portion of the construction object reaches the bearing stratum. As an example, in a case in which the bearing stratum is present at a depth of 10 m from the surface of the ground, the construction object is penetrated by at least 10 m from the surface of the ground. Accordingly, in the vibratory hammer construction method, it is necessary to determine a vertical distance from the surface of the ground to the bearing stratum, that is, a depth of the bearing stratum. In the related art, to determine the depth of the bearing stratum, a standard penetration test was made. In the standard penetration test, the depth of the bearing stratum was determined by measuring an N-value. The N-value is the number of impacts required to penetrate a sampler that is a reference pile into the ground by 30 cm by causing a hammer having mass of about 3.5 kg to freely fall from a height of about 76 cm. That is, the N-value is an index for determining the depth of the bearing stratum.

EMBODIMENTS

Hereinafter, an embodiment of a system 1 for calculating construction assistance information will be described with reference to the drawings. First, an outline of a constitution of the system 1 for calculating construction assistance information will be described with reference to FIG. 1.

FIG. 1 is a schematic diagram illustrating the outline of the constitution of the system 1 for calculating construction assistance information. The system 1 for calculating construction assistance information includes a device 100 for calculating construction assistance information and a vibratory hammer construction machine 200. Of these components, the vibratory hammer construction machine 200 will be described first.

The vibratory hammer construction machine 200 includes a vibratory hammer 210 and a crane 220. The vibratory hammer 210 includes a motor, an eccentric mass, a rotary shaft, and a grasper, all of which is not illustrated. The motor rotates the rotary shaft according to the number of rotations based on control of a controller (not shown) which the vibratory hammer construction machine 200 has. The rotary shaft connects the motor which the vibratory hammer 210 has and the eccentric mass to each other. The eccentric mass is rotated along with the rotation of the rotary shaft. The motor rotates the rotary shaft, and thereby rotates the eccentric mass. The eccentric mass is rotated, and thereby a force changed depending on a rotational period of the eccentric mass is generated.

The eccentric mass has an amount of eccentricity that can be changed on the basis of the control of the controller (not shown) which the vibratory hammer construction machine 200 has. To be specific, the eccentric mass can be displaced in a radial direction of the rotary shaft by a hydraulic cylinder. The controller which the vibratory hammer construction machine 200 has controls a hydraulic pressure supplied to the hydraulic cylinder of the eccentric mass, and thereby changes a radial position of the eccentric mass. In a case in which the amount of eccentricity of the eccentric mass is great, the eccentric mass is rotated, and thereby a great force is generated in comparison with a case in which the amount of eccentricity is small.

A vertical component of the force generated by the rotation of the eccentric mass is referred to as a eccentricity force Fi. To be more specific, a vertical component generated whenever the eccentric mass rotates once is referred to as the eccentricity force Fi. The number of rotations of the rotary shaft is referred to as the number of impacts N.

The vibratory hammer construction machine 200 changes the amount of eccentricity of the eccentric mass, and thereby changes the eccentricity force Fi. The vibratory hammer construction machine 200 changes the number of rotations of the motor, and thereby changes the number of impacts N.

Here, when the underground side leading end of the construction object H makes a comparison between the case of a hard stratum and the case of a soft stratum, a force required to penetrate the construction object H by a certain depth (e.g., 0.1 m) is greater in the case of the hard stratum. The vibratory hammer construction machine 200 carries out construction by changing the eccentricity force Fi and the number of impacts N of the vibratory hammer 210 depending on hardness of the stratum.

In the following description, a distance between the underground side leading end of the construction object H buried by the vibratory hammer construction machine 200 and the surface of the ground SF is referred to as a penetration depth d.

The vibratory hammer construction machine 200 detects the eccentricity force Fi, the number of impacts N, and the penetration depth d, and outputs the detected information to an external device. To be specific, the vibratory hammer construction machine 200 outputs the amount of eccentricity of the eccentric mass of the vibratory hammer 210 to the external device as information indicating the eccentricity force Fi. The vibratory hammer construction machine 200 outputs the number of rotations of the motor of the vibratory hammer 210 to the external device as information indicating the number of impacts N. The vibratory hammer construction machine 200 outputs a difference between a winding-down amount of the crane at the time of initiating the construction and a winding-down amount of the crane during the construction or at the time of completing the construction to the external device as information indicating the penetration depth d. In the following description, these pieces of information output by the vibratory hammer construction machine 200 are also described as construction information "info".

In the present embodiment, the case in which the eccentricity force Fi is an instructioN-value (a target value) of the amount of eccentricity which the controller of the vibratory hammer construction machine 200 outputs has been described by way of example, but the present embodiment is not limited thereto. For example, the vibratory hammer construction machine 200 may include a sensor for detecting the force generated by the vibratory hammer 210. In this case, the eccentricity force Fi may be a value detected by this sensor. When the vibratory hammer construction machine 200 can detect a force transmitted from the vibratory hammer 210 to the construction object, the eccentricity force Fi may be the force transmitted from the vibratory hammer 210 to the construction object H.

In the present embodiment, the case in which the construction object H is H-section steel used as a foundation pile of the building has been described, but the present embodiment is not limited thereto. Anything will do if the construction object H is penetrated into the ground by the vibratory hammer 210. For example, the construction object may be a steel pipe or a steel sheet pile.

Next, details of the constitution of the system 1 for calculating construction assistance information will be described with reference to FIG. 2.

Figure 2:
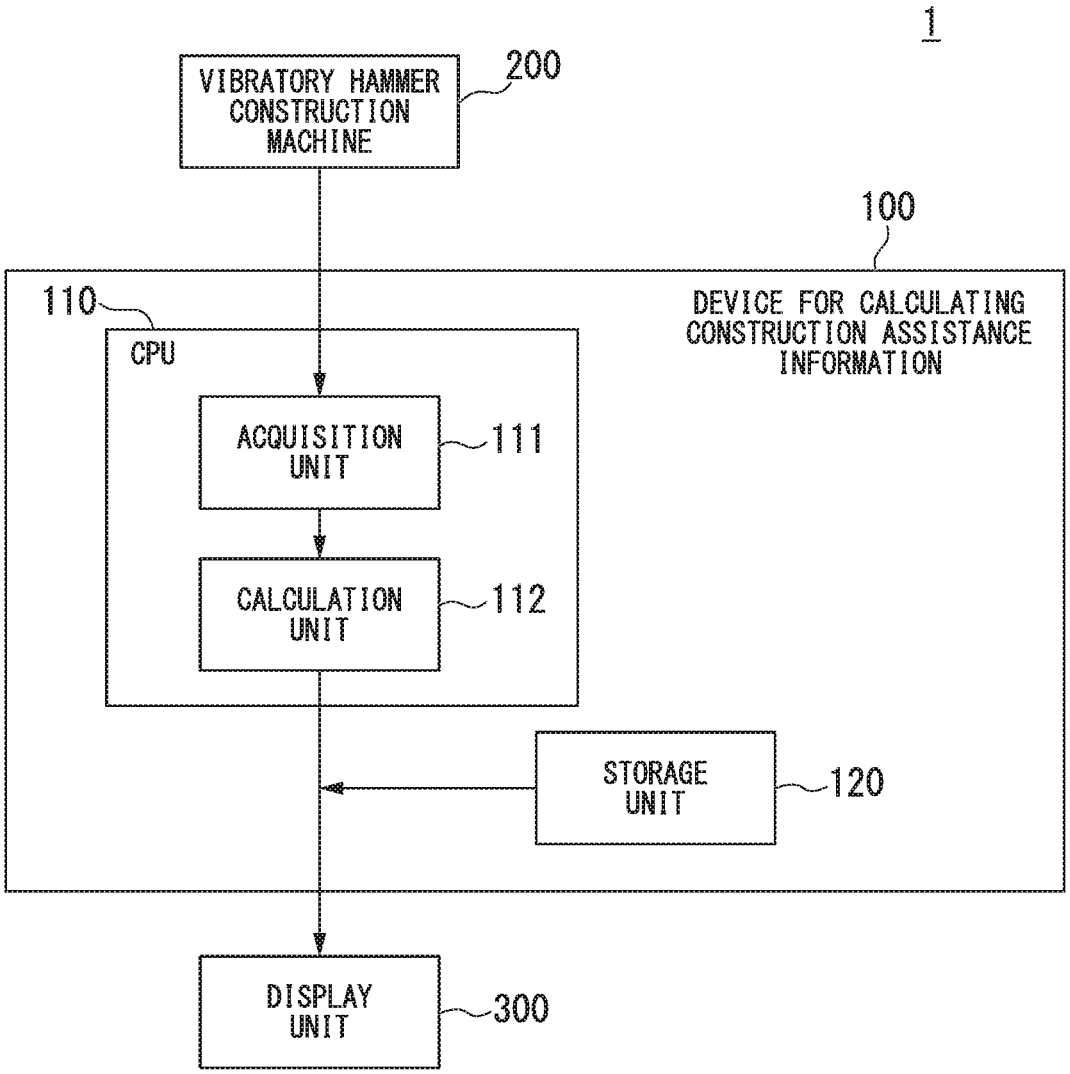
FIG. 2 is an outline diagram illustrating an example of the constitution of the system for calculating construction assistance information according to the present embodiment.

FIG. 2 is an outline diagram illustrating an example of a functional constitution of the device 100 for calculating construction assistance information. The system 1 for calculating construction assistance information includes the device 100 for calculating construction assistance information and a display unit 300 in addition to the aforementioned vibratory hammer construction machine 200.

The device 100 for calculating construction assistance information acquires the construction information "info" from the vibratory hammer 210. The information indicating the eccentricity force Fi, the information indicating the number of impacts N, and the information indicating the penetration depth d are contained in the construction information "info". The device 100 for calculating construction assistance information determines the depth of the bearing stratum on the basis of the eccentricity force Fi, the number of impacts N, and the penetration depth d. A function constitution of the device 100 for calculating construction assistance information will be described.

The device 100 for calculating construction assistance information includes a central processing unit (CPU) 110 and a storage unit 120.

The CPU 110 includes an acquisition unit 111 and a calculation unit 112 that act as functional units thereof.

The acquisition unit 111 is connected with the controller (not shown) of the vibratory hammer 210. The acquisition unit 111 acquires the construction information "info" from the vibratory hammer construction machine 200, and supplies the acquired construction information "info" to the calculation unit 112.

The acquisition unit 111 acquires the construction information "info" at a predetermined timing. In this example, a case in which the timing at which the construction information "info" is acquired by the acquisition unit 111 is preset on the basis of the penetration depth d of the construction object H into the ground or a construction time of the vibratory hammer construction machine 200 will be described.

First, an example of the case in which the timing at which the construction information "info" is acquired by the acquisition unit 111 is set on the basis of the penetration depth d of the construction object H into the ground will be described.

The acquisition unit 111 acquires the construction information "info" from the vibratory hammer construction machine 200 at each preset unit penetration length of the construction object H. The unit penetration length may be for instance 1 cm or 1 m. When the unit penetration length is set to 1 cm, the acquisition unit 111 acquires the construction information "info" from the vibratory hammer construction machine 200 whenever the construction object H is penetrated into the ground by 1 cm. That is, the acquisition unit 111 acquires the construction information "info" from the vibratory hammer construction machine 200 whenever the penetration depth d is increased by 1 cm.

Thereby, the acquisition unit 111 acquires the construction information "info" at the timing based on the penetration depth d of the construction object H into the ground.

Next, an example of the case in which the timing at which the construction information "info" is acquired by the acquisition unit 111 is set on the basis of the construction time of the vibratory hammer construction machine 200 will be described.

The acquisition unit 111 acquires the construction information "info" from the vibratory hammer construction machine 200 at each preset unit construction time of the construction. The unit construction time may be for instance 1 minute or 10 minutes. When the unit construction time is set to 1 minute, the vibratory hammer construction machine 200 initiates the construction, and then the acquisition unit 111 acquires the construction information "info" from the vibratory hammer construction machine 200 at each 1 minute.

Thereby, the acquisition unit 111 acquires the construction information "info" at the timing based on the construction time of the vibratory hammer construction machine 200.

In the above description, the case in which the acquisition unit 111 acquires the construction information "info" at the periodic timing of each of the unit penetration length and the unit construction time has been described, but the embodiment is not limited thereto. For example, the acquisition unit 111 may acquire the construction information "info" at the periodic timings of both the unit penetration length and the unit construction time. To be specific, when the unit penetration length is set to 1 cm and when the unit construction time is set to 1 minute, the acquisition unit 111 acquires the construction information "info" at the timings of both of whenever the penetration depth d is increased by 1 cm and whenever the construction time has elapsed by 1 minute.

The acquisition unit 111 may acquire the construction information "info" at a timing different from the periodic timing based on the unit penetration length or the unit construction time. For example, the acquisition unit 111 may acquire the construction information "info" at an arbitrary timing. To be specific, when the construction object H is constructed, a builder P may estimate that the construction object reaches the hard stratum from the eccentricity force Fi, the number of impacts N, and the penetration depth d detected by the vibratory hammer construction machine 200. In this case, the acquisition unit 111 acquires the construction information "info" from the vibratory hammer construction machine 200 at an arbitrary timing different from the periodic timing.

The calculation unit 112 calculates an accumulated impact force Ev on the basis of the eccentricity force Fi, the number of impacts N, and the penetration depth d that are supplied from the acquisition unit 111 and are contained in the construction information "info".

The accumulated impact force Ev is an index from which it is determined whether or not the construction object H is situated at a depth of the bearing stratum BS. The accumulated impact force Ev is expressed by Formula (1).

Formula 1

$$Ev = \sum_{i=1}^{N} F_i / d \tag{1}$$

The calculation unit 112 may sequentially calculate the accumulated impact force Ev on the basis of the construction information "info" acquired from the acquisition unit 111, and may collectively calculate the accumulated impact force Ev after the construction of the vibratory hammer construction machine 200 is completed.

The accumulated impact force Ev calculated by the calculation unit 112 is stored in the storage unit 120.

The display unit 300 displays the accumulated impact force Ev calculated by the calculation unit 112. The display unit 300 includes a display, and displays the accumulated impact force Ev calculated by the calculation unit 112 on a screen.

The accumulated impact force Ev calculated by the calculation unit 112 is displayed, and thereby the builder P can determine whether or not the construction object H is situated at the bearing stratum BS. The calculation unit 112 supplies the calculated accumulated impact force Ev to the storage unit 120 and the display unit 300.

Next, an operation of the system 1 for calculating construction assistance information will be described with reference to FIG. 3.

Figure 3:
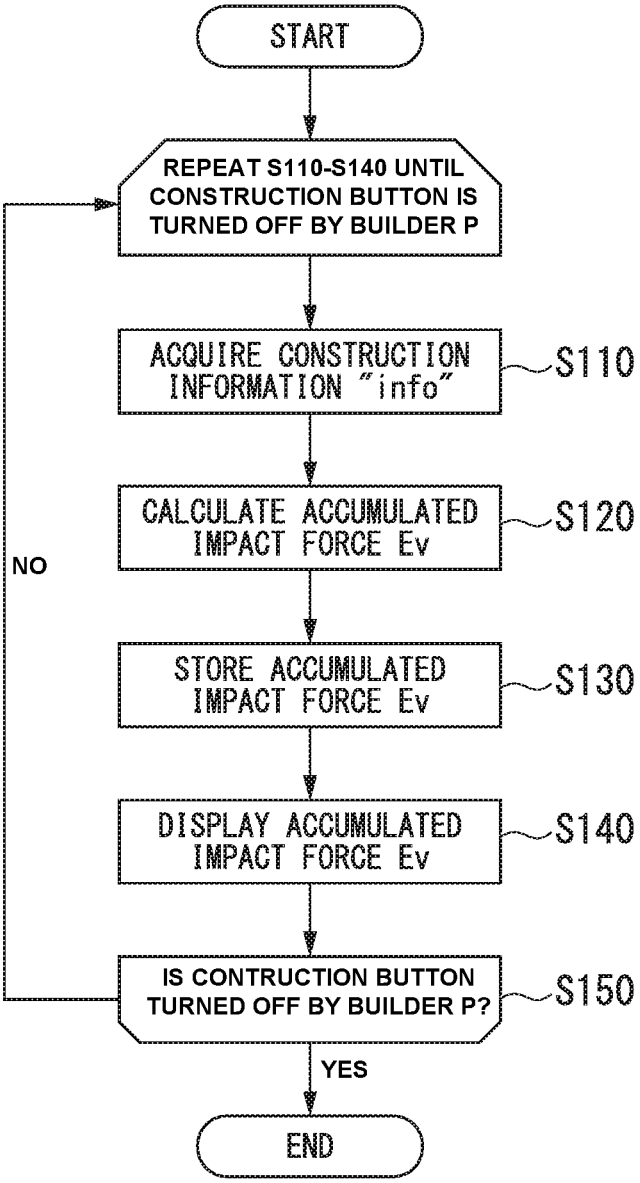
FIG. 3 is a flowchart illustrating an example of an operation of the system for calculating construction assistance information according to the present embodiment.

FIG. 3 is a flowchart illustrating an example of an operation of the system 1 for calculating construction assistance information. The system 1 for calculating construction assistance information conducts steps S110 to S150 shown in FIG. 3 on the basis of a bearing stratum measurement program Prg10. Here, the bearing stratum measurement program Prg10 is a control program which the system 1 for calculating construction assistance information uses to calculate the accumulated impact force Ev. An operator of the vibratory hammer construction machine 200, a construction supervisor or the like is generically called a builder P.

Here, a case in which the start and end of construction of the vibratory hammer construction machine 200 are controlled by ON and OFF of a construction button will be described by way of example. To be specific, in the case of this example, the builder P sets the construction button to ON, and thereby the construction is started. In addition, the builder P sets the construction button to OFF, and thereby the construction is ended.

The construction button is set to ON by the builder P, and thereby the bearing stratum measurement program Prg10 begins to be executed.

The acquisition unit 111 acquires construction information "info" from the vibratory hammer 210 (step S110). The calculation unit 112 calculates an accumulated impact force Ev on the basis of the construction information "info" acquired from the acquisition unit 111 (step S120). The storage unit 120 stores the accumulated impact force Ev calculated by the calculation unit 112 (step S130). The display unit 300 displays the accumulated impact force Ev calculated by the calculation unit 112 (step S140).

The actions from step S110 to step S140 are repeated until the construction button of the vibratory hammer 210 is set to OFF by the builder P (step S150).

Here, the case in which the bearing stratum measurement program Prg10 is repeated and executed until the construction button of the vibratory hammer 210 is set to OFF by the builder P has been described as an example, but the embodiment is not limited thereto. For example, the device 100 for calculating construction assistance information may determine the end of construction on the basis of the accumulated impact force Ev calculated by the calculation unit 112. To be specific, the device 100 for calculating construction assistance information may pre-store information about a threshold of the accumulated impact force Ev, determine that the construction is ended when the accumulated impact force Ev calculated by the calculation unit 112 reaches the threshold, and end the construction.

Next, an example in which the accumulated impact force Ev is displayed by the display unit 300 will be described with reference to FIG. 4.

Figure 4:
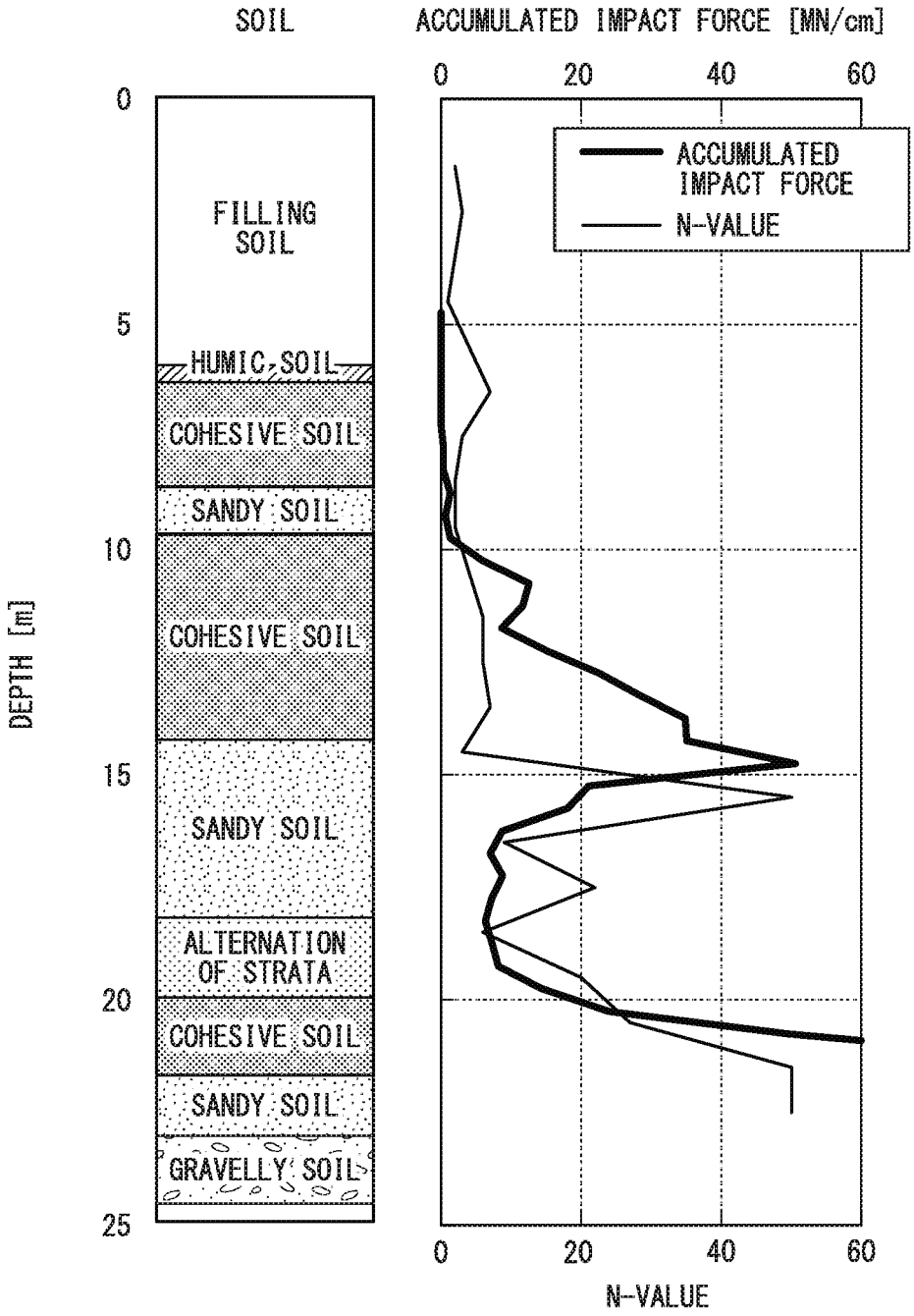
FIG. 4 is a schematic diagram illustrating an example in which an accumulated impact force is displayed by a display unit according to the present embodiment.

FIG. 4 is a schematic diagram illustrating an example in which the accumulated impact force is displayed by the display unit 300.

FIG. 4 illustrates an example of the display of the display unit 300 when the construction object H is buried in a stratum that is an alternation of strata. The display unit 300 plots the accumulated impact force Ev calculated by the calculation unit 112 on a graph. That is, the display unit 300 together displays two pieces of information about the penetration depth d of the construction object H and the accumulated impact force Ev.

Thereby, the builder P can visually determine the bearing stratum BS of the construction object H.

The display unit 300 sequentially displays the accumulated impact force Ev calculated by the calculation unit 112. Thereby, the builder P makes sequential reference to the accumulated impact force Ev using the display unit 300, and thereby can determine a depth of the bearing stratum BS in a field under construction in real time.

For example, as illustrated in FIG. 4, the display unit 300 displays an N-value for a stratum around the construction object H by combining an N-value, which is previously measured by a standard penetration test, and the accumulated impact force Ev. Thus, the builder P can also make sequential reference to a relation between the N-value and the accumulated impact force Ev by visual observation.

Next, an example in which the accumulated impact force Ev is calculated by the calculation unit 112 will be further described with reference to FIGS. 5 to 7.

Figure 5:
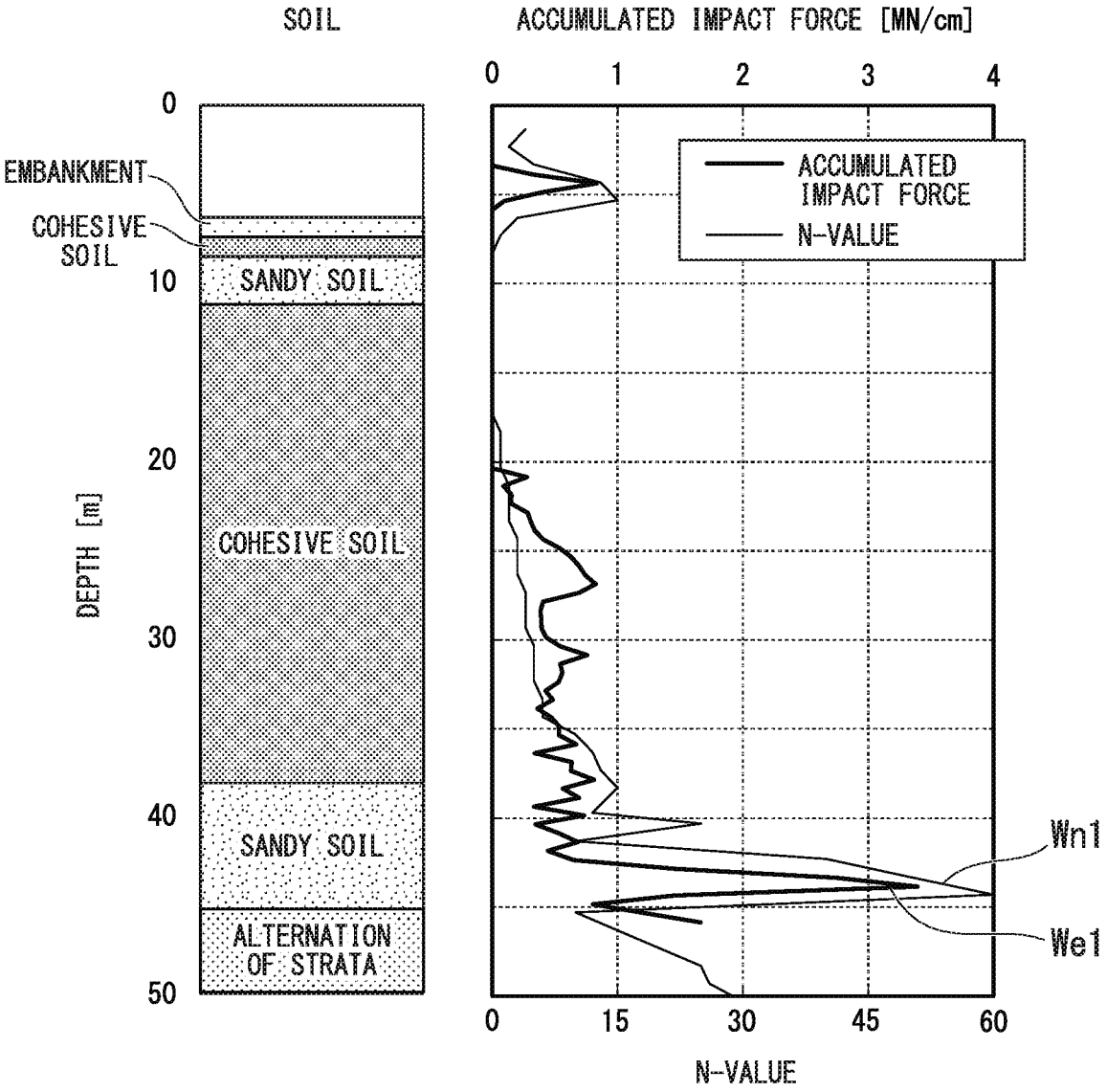
FIG. 5 is a schematic diagram illustrating a first modification in which the accumulated impact force is calculated by a calculation unit according to the present embodiment.

FIG. 5 is a schematic diagram illustrating a first modification in which the accumulated impact force Ev is calculated by the calculation unit 112. In this example, a stratum is a hard cohesive soil layer when a depth ranges from about 20 to 40 m, and a sandy soil layer when a depth exceeds about 40 m. In this example, the sandy soil layer is a bearing stratum. A curve Wn1 showing a change in the N-value that is a result of the standard penetration test for this stratum and a curve We1 showing a change in the accumulated impact force Ev when the construction object H is buried in this stratum are plotted in FIG. 5.

Here, the curve Wn1 ascends at a depth of about 3 m, and descends at a depth of about 5 m. The curve Wn1 gradually ascends from a depth of about 20 m to a depth of about 40 m. Further, the curve Wn1 ascends from a depth of about 42 m, and descends from a depth of about 45 m.

The curve We1 ascends at a depth of about 3 m, and descends at a depth of about 5 m. The curve We1 gradually ascends from a depth of about 20 m to a depth of about 40 m. Further, the curve We1 ascends from a depth of about 42 m, and descends from a depth of about 45 m.

Making a comparison between the curve Wn1 and the curve We1, the accumulated impact force Ev and the N-value show the same change. That is, in the stratum of the first example, it can be said that a correlation between the accumulated impact force Ev and the N-value is high.

Figure 6:
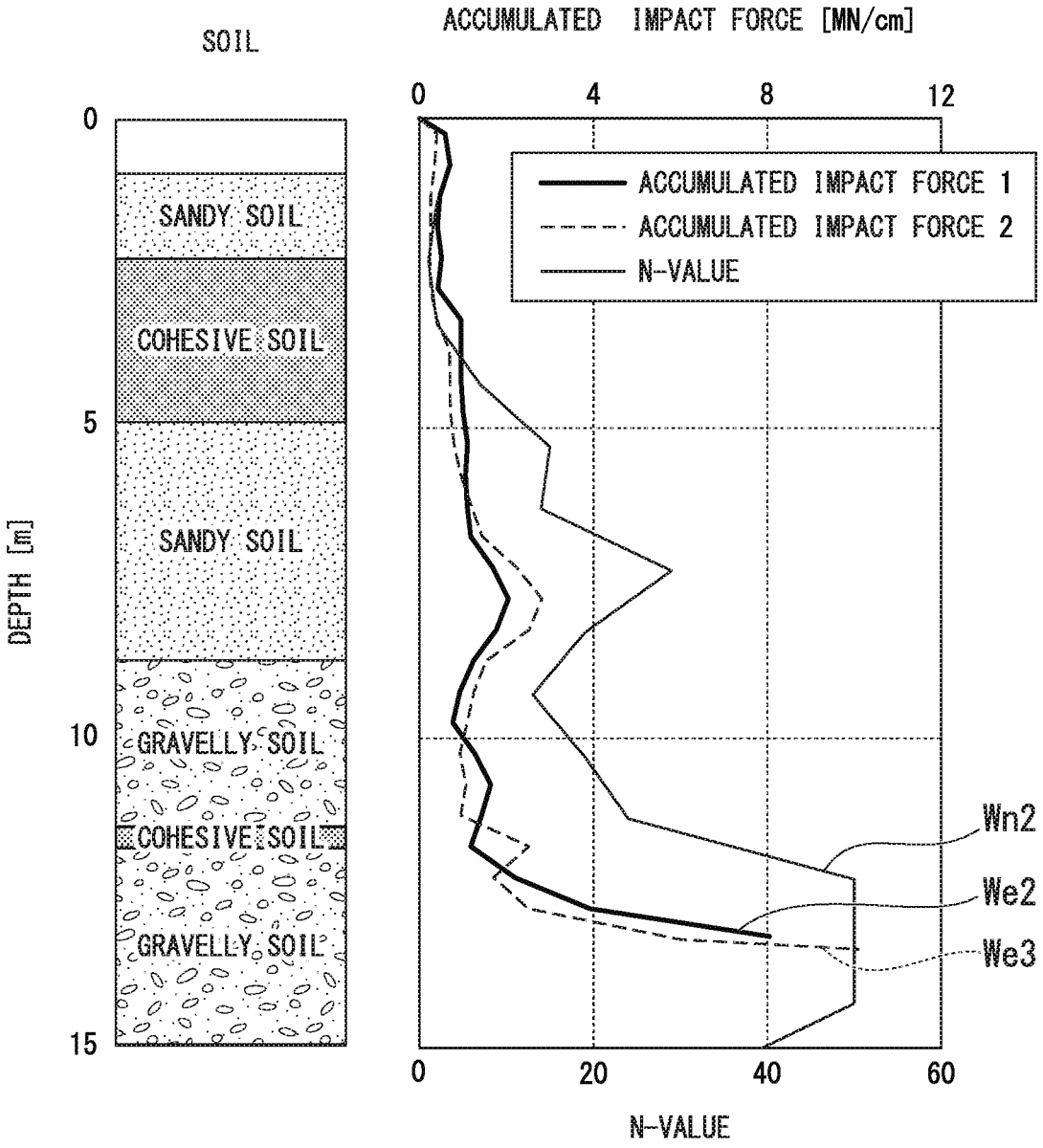
FIG. 6 is a schematic diagram illustrating a second modification in which the accumulated impact force is calculated by the calculation unit according to the present embodiment.

FIG. 6 is a schematic diagram illustrating a second modification in which the accumulated impact force Ev is calculated by the calculation unit 112. In this example, a stratum is a sandy soil layer when a depth is about 7 m, and a gravelly soil layer when a depth exceeds about 9 m. In this example, the gravelly soil layer is a bearing stratum. A curve Wn2 showing a change in the N-value that is a result of the standard penetration test for this stratum and curves We2 and We3 showing a change in the accumulated impact force Ev when the two construction objects H are buried in this stratum are plotted in FIG. 6.

Here, the curve Wn2 ascends at a depth of about 7 m, and descends at a depth of about 9 m. The curve Wn2 ascends at a depth of about 13 m.

Next, the curve We2 ascends at a depth of about 7 m, and descends at a depth of about 9 m. The curve We2 ascends at a depth of about 13 m.

Next, the curve We3 ascends at a depth of about 7 m, and descends at a depth of about 9 m. The curve We3 ascends at a depth of about 13 m.

Making a comparison among the curve Wn2, the curve We2, and the curve We3, the accumulated impact force Ev and the N-value show the same change. That is, in the stratum of the second example, it can be said that a correlation between the accumulated impact force Ev and the N-value is high.

Figure 7:
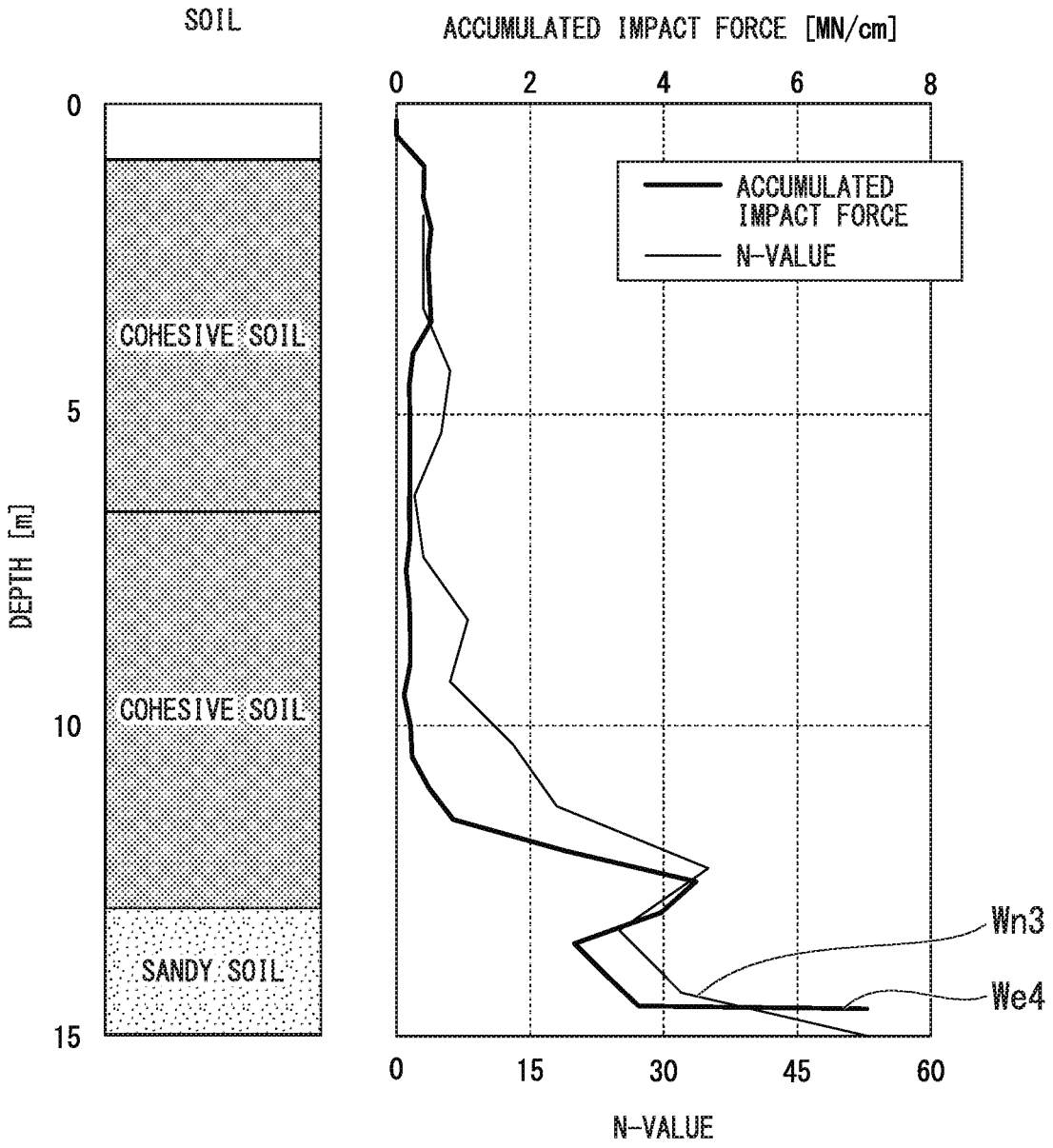
FIG. 7 is a schematic diagram illustrating a third modification in which the accumulated impact force is calculated by the calculation unit according to the present embodiment.

FIG. 7 is a schematic diagram illustrating a third modification in which the accumulated impact force Ev is calculated by the calculation unit 112. In this example, a stratum is a cohesive soil layer when a depth is about 13 m, and a sandy soil layer when a depth is greater than 13 m. In this example, the sandy soil layer is a bearing stratum. A curve Wn3 showing a change in the N-value that is a result of the standard penetration test for this stratum and a curve We4 showing a change in the accumulated impact force Ev when the construction object H is buried in this stratum are plotted in FIG. 7.

Here, the curve Wn3 ascends at a depth of about 13 m, and descends at a depth of about 14 m. The curve Wn3 ascends at a depth of about 15 m.

The curve We4 ascends at a depth of about 13 m, and descends at a depth of about 14 m. The curve We4 ascends at a depth of about 15 m.

Making a comparison between the curve Wn3 and the curve We4, the accumulated impact force Ev and the N-value show the same change. That is, in the stratum of the third example, it can be said that a correlation between the accumulated impact force Ev and the N-value is high.

Consequently, it can be said that, in any of the layers, the correlation between the accumulated impact force Ev calculated by the device 100 for calculating construction assistance information and the N-value measured by the standard penetration test is high.

That is, according to the system 1 for calculating construction assistance information of the present embodiment, even when the stratums are different in quality, the depth of the bearing stratum BS can be determined by making reference to the accumulated impact force Ev.

As described above, the system 1 for calculating construction assistance information of the present embodiment includes the device 100 for calculating construction assistance information and the vibratory hammer 210.

The device 100 for calculating construction assistance information includes the acquisition unit 111 and the calculation unit 112. The acquisition unit 111 acquires the detected information from the vibratory hammer 210. Here, the detected information acquired by the acquisition unit 111 is information in which the values indicating the eccentricity force Fi and the number of impacts N imparted to the construction object H and the penetration depth d of the construction object H are at least contained. The eccentricity force Fi, the number of impacts N, and the penetration depth d are parameters intrinsic to the vibratory hammer construction method. Thus, the calculation unit 112 calculates the accumulated impact force Ev on the basis of the detected information. A builder P can accurately find the depth of the bearing stratum BS by making reference to the accumulated impact force Ev which the system 1 for calculating construction assistance information calculates.

Meanwhile, in the related art, the builder determined the depth of the bearing stratum BS on the basis of the N-value acquired by making the standard penetration test. In the standard penetration test, the N-value is measured by penetrating the sampler apart from the construction object H into the ground. That is, in the construction based on the related art, to accurately find the depth of the bearing stratum BS, there was a need to penetrate the sampler apart from the construction object H into the ground.

According to the system 1 for calculating construction assistance information of the present embodiment, without measuring the N-value from the sampler for each construction object H, the builder P can determine the depth of the bearing stratum BS by making reference to the accumulated impact force Ev which the system 1 for calculating construction assistance information calculates. That is, according to the system 1 for calculating construction assistance information, without making the standard penetration test, the index indicating the depth of the bearing stratum BS can be accurately calculated. That is, according to the system 1 for calculating construction assistance information of the present embodiment, the index indicating the depth of the bearing stratum BS can be accurately calculated for each construction object H in the vibratory hammer construction method.

The calculation unit 112 of the present embodiment calculates the accumulated impact force Ev on the basis of the detected information acquired from the acquisition unit 111. The calculation unit 112 calculates the accumulated impact force Ev on the basis of a ratio between a product of the eccentricity force Fi and the number of impacts N for the construction object H and the penetration depth d of the construction object H. The accumulated impact force Ev calculated by the calculation unit 112 is an index having a high correlation with the N-value measured by making the standard penetration test. That is, the system 1 for calculating construction assistance information of the present embodiment calculates the accumulated impact force Ev that is the index having the high correlation with the N-value by means of simple computation.

The system 1 for calculating construction assistance information of the present embodiment calculates the accumulated impact force Ev on the basis of the detected information associated with the construction by means of simple computation. Consequently, the system 1 for calculating construction assistance information of the present embodiment can calculate the accumulated impact force Ev in real time. That is, according to the system 1 for calculating construction assistance information of the present embodiment, the builder P can determine the depth of the bearing stratum BS on the spot by making reference to the accumulated impact force Ev calculated in real time.

The acquisition unit 111 of the present embodiment sequentially acquires the detected information with respect to each variation such as each unit construction time of construction of the vibratory hammer 210 or each unit penetration depth of the construction object H.

The calculation unit 112 sequentially acquires the accumulated impact force Ev on the basis of the detected information that is acquired by the acquisition unit 111 and varies momentarily with respect to each variation. That is, the calculation unit 112 sequentially acquires the accumulated impact force Ev that varies momentarily depending on the detected information of each variation.

Thus, the system 1 for calculating construction assistance information of the present embodiment sequentially acquires the accumulated impact force Ev that varies momentarily depending on the detected information of each variation. The builder P can sequentially determine the depth of the bearing stratum BS by making reference to the accumulated impact force Ev that is sequentially acquired.

The device 100 for calculating construction assistance information of the present embodiment includes the storage unit 120. The accumulated impact force Ev calculated by the calculation unit 112 is stored in the storage unit 120.

Thus, for example, the accumulated impact force Ev can be read out of the storage unit 120 and be plotted as a graph. The builder P makes reference to the graph during or after the construction, and thereby can check a tendency of the accumulated impact force Ev.

That is, according to the system 1 for calculating construction assistance information of the present embodiment, it can be checked whether or not the depth of the bearing stratum BS is correct during or after the construction.

The system 1 for calculating construction assistance information of the present embodiment includes the display unit 300. The display unit 300 displays the accumulated impact force Ev calculated by the calculation unit 112. Thereby, the display unit 300 can sequentially display the accumulated impact force Ev calculated by the calculation unit 112.

For example, the builder P makes reference to this display on the spot under construction, and thereby it can be visually determined whether or not the depth of the bearing stratum BS is adequate.

Therefore, according to the system 1 for calculating construction assistance information of the present embodiment, it can be visually determined whether or not the depth of the bearing stratum BS is adequate.

Although the embodiments of the present invention have been described above in detail with reference to the drawings, the specific constitution is not limited to the embodiments, and may be appropriately modified without departing from the spirit and scope of the present invention. Further, the constitutions described in each of the above embodiments may be combined.

Each of the units included in the device 100 for calculating construction assistance information in the above embodiment may be realized by dedicated software or by a memory and a microprocessor.

Each of the units included in the device 100 for calculating construction assistance information may be made up of a memory and a central processing unit (CPU). A program for realizing a function of each of the units included in the device 100 for calculating construction assistance information may be loaded and executed on the memory, and thereby realize the function.

The program for realizing functions of each of the units included in the device 100 for calculating construction assistance information may be recorded on a computer-readable recording medium. The program recorded on the recording medium may be caused to be read and executed in a computer system, and thereby conduct processing. The "computer system" used herein may include hardware such as OS or a peripheral.

The "computer system" may also include a homepage providing environment (or a display environment) if WWW system is used.

The "computer-readable recording medium" refers to a portable medium such as a flexible disk, a magneto optical disk, ROM, CD-ROM, or the like, or a medium for a storage device such as a hard disk installed in a computer system.

Further, the "computer-readable recording medium" may include a medium that dynamically holds a program for a short time like a communication line when the program is transmitted via a network such as Internet or a communication circuit such as a phone circuit, or a medium that holds a program for a fixed time like a volatile memory inside a computer system serving as a server or a client in that case. Such a program may be a program for realizing a part of the aforementioned function, or a program capable of realizing the aforementioned function by a combination with a program that is previously recorded on a computer system.

REFERENCE SIGNS LIST

1 System for calculating construction assistance information
100 Device for calculating construction assistance information
111 Acquisition unit
112 Calculation unit
120 Storage unit
200 Vibratory hammer construction machine
210 Vibratory hammer
220 Crane

The invention claimed is:

1. A system for calculating construction assistance information comprising: a device for calculating construction assistance information;

a vibratory hammer construction machine, and a display unit configured to display a result of calculation of a calculation unit which the device for calculating construction assistance information has, wherein the device for calculating construction assistance information comprises:

an acquisition unit configured to acquire information, which contains at least values indicating an eccentricity force Fi of a vibratory hammer which the vibratory hammer construction machine imparts to a construction object, a number of impacts N, and a penetration depth d of the construction object, from the vibratory hammer construction machine; and the calculation unit configured to calculate a value of a product of the eccentricity force Fi and the number of impacts N divided by the penetration depth d of the construction object, and to calculate an accumulated impact force Ev on the basis of the eccentricity force Fi, the accumulated impact force Ev indicating a work load of construction caused by the vibratory hammer, wherein Ev is given by:

$$E_V = \sum_{i=1}^{N} F_i / d$$

wherein the eccentricity force Fi, the number of impacts N, and the penetration depth d is contained in the information acquired by the acquisition unit, and construction of the construction object by the vibratory hammer construction machine is ended when the ratio calculated by the calculation unit is equal to or greater than a predetermined ratio.

* * * * *